US007836942B2

(12) United States Patent
Cannas

(10) Patent No.: US 7,836,942 B2
(45) Date of Patent: Nov. 23, 2010

(54) HEAT EXCHANGER AND METHOD OF PRODUCING THE SAME

(75) Inventor: Christian Cannas, Mandello Del Lario (IT)

(73) Assignee: Riello S.p.A., Legnago (IT)

( * ) Notice: Subject to any disclaimer, the term of this patent is extended or adjusted under 35 U.S.C. 154(b) by 445 days.

(21) Appl. No.: 11/702,174

(22) Filed: Feb. 5, 2007

(65) Prior Publication Data

US 2008/0185131 A1 Aug. 7, 2008

(51) Int. Cl.
*F24H 1/43* (2006.01)
*F28D 1/047* (2006.01)

(52) U.S. Cl. ..... 165/163; 165/181; 165/183

(58) Field of Classification Search ..... 165/156, 165/162, 163
See application file for complete search history.

(56) References Cited

U.S. PATENT DOCUMENTS 1,945,287 A * 1/1934 Monree ..... 165/119
4,276,930 A * 7/1981 Weber ..... 165/172
6,321,835 B1 * 11/2001 Damsohn et al. ..... 165/159
2001/0031440 A1 * 10/2001 Fullemann et al. ..... 432/175
2002/0092646 A1 * 7/2002 Kuhn et al. ..... 165/163
2004/0261986 A1 * 12/2004 Insalaco ..... 165/181

FOREIGN PATENT DOCUMENTS

EP 0678186 A 10/1995
EP 0814312 A 12/1997
FR 2124043 A 9/1972
WO WO 2004/090434 A1 10/2004

OTHER PUBLICATIONS

European Search Report mailed Feb. 10, 2006 in European Appln. No. 05107265.0-2301.

* cited by examiner

*Primary Examiner*—Allen J Flanigan
(74) *Attorney, Agent, or Firm*—Davidson Berquist Jackson & Gowdey LLP

(57) ABSTRACT

A heat exchanger for a gas boiler for producing hot water is provided with a casing extending along a first axis and through which combustion fumes flow; a tube forming a plurality of turns along which water flows arranged inside the casing so as to form gaps between adjacent turns; a disk for guiding said fumes trough the gaps; and teeth integrally made with the tube for spacing adjacent turns apart and forming said gaps.

13 Claims, 3 Drawing Sheets

11
22
25
25
23
24
26a
X
21
21b
Y
A2
27a
26
27

22
25
25
28a
28
21a
21
29
29a
23
24
25
21b
Y
A2
27a
27
26
26a
X
11

HEAT EXCHANGER AND METHOD OF PRODUCING THE SAME

The present invention relates to a heat exchanger.

More specifically, the present invention relates to a heat exchanger for a gas boiler for producing hot water.

BACKGROUND OF THE INVENTION

A gas boiler for producing hot water normally comprises a gas burner, and at least one heat exchanger through which combustion fumes and water flow. Some types of gas boilers, known as condensation boilers, condense the steam in the combustion fumes and transfer the latent heat in the fumes to the water. Condensation boilers are further divided into a first type, equipped with a first exchanger close to the burner, and a second exchanger for simply condensing the fumes; and a second type, equipped with only one heat exchanger which provides solely for thermal exchange along a first portion, and for both thermal exchange and fume condensation along a second portion. Condensation or dual-function exchangers of the above type normally comprise a casing extending along a first axis and through which combustion fumes flow; and a tube along which water flows, and which extends along a second axis and coils about the first axis to form a succession of turns. The combustion fumes flow over and between the turns to transfer heat to the water flowing along the tube.

EP 0 678 186 discloses a heat exchanger for a gas boiler for producing hot water. The heat exchanger comprises a casing extending along a first axis and through which combustion fumes flow; a tube forming a plurality of tube sections along which water flows; said tube sections being arranged inside said casing so as to forms gaps between adjacent tube sections; guiding means for guiding said fumes trough said gaps; and bosses for spacing adjacent tube sections.

Each tube section is provided with a cross section delimited by two parallel, opposite, flat walls. Bosses protrude from one of said flat walls for abutting a flat wall without bosses of an adjacent tube section and forming the above mentioned gaps between adjacent tube sections.

Even though the above described heat exchanger is provided with integrally made spacers, a rather expensive and time-consuming hydro-forming process is needed to form bosses in tube sections. The hydro-forming process is performed by a press that squeezes the tube sections between dies in order to form the flat walls and, at the same time, forms the bosses by injecting inside the tube sections a fluid under high pressure. It follows that hydro-forming process lacks flexibility because a modification of the distributions pitch or the height of the bosses requires different dies.

In addition to that, the process is not extremely accurate and small gaps cannot be formed by embossed tube sections.

SUMMARY OF THE INVENTION

It is an object of the present invention to provide a heat exchanger for a gas boiler for producing hot water, which overcomes the drawbacks of the prior art.

According to the present invention, there is provided a heat exchanger for a gas boiler for producing hot water; characterised in that said spacing means are teeth integrally made with said tube.

Replacing bosses with teeth has the advantage of not requiring hydro-forming process and increasing the accuracy.

The present invention also relates to a method of producing a heat exchanger.

According to the present invention, there is provided a method of producing a heat exchanger, as claimed in the attached Claims.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
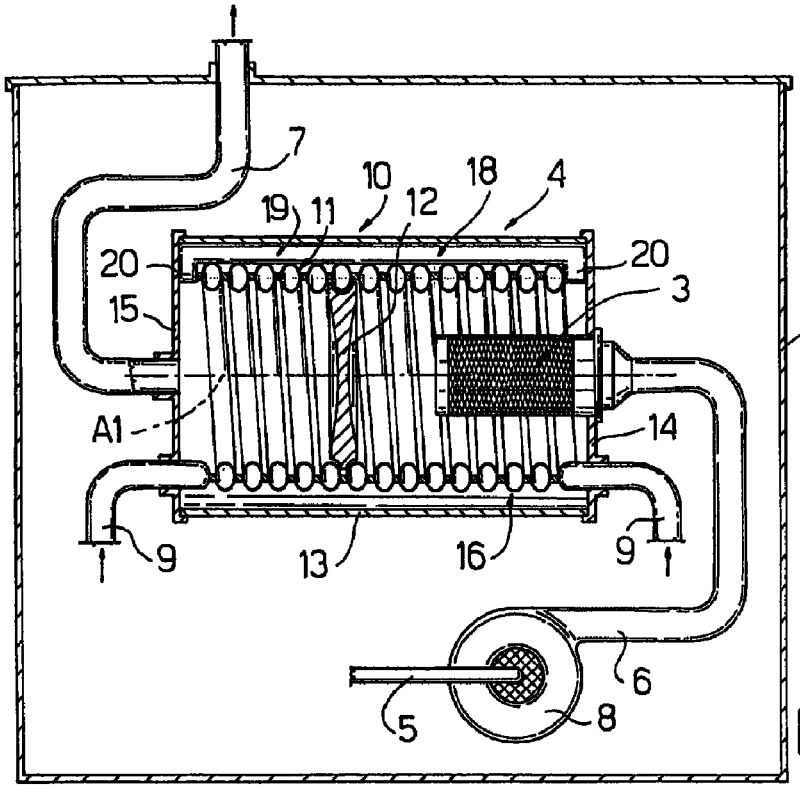
FIG. 1 shows a schematic front view, with parts in section and parts removed for clarity, of a gas boiler equipped with a heat exchanger in accordance with the present invention.

Number 1 in FIG. 1 indicates as a whole a gas boiler. Boiler 1 is a wall-mounted condensation boiler, i.e. in which the vapour in the combustion fumes is condensed, and comprises an outer structure 2 in which are housed a burner 3; a heat exchanger 4; a gas supply conduit 5; a pipe 6 for supplying an air-gas mixture to burner 3; a combustion gas exhaust pipe 7; a fan 8 connected to supply pipe 6, and which performs the dual function of supplying the air-gas mixture to burner 3, and expelling the combustion fumes; and a water circuit 9. Burner 3 is connected to pipe 6, is cylindrical in shape, and comprises a lateral wall with holes (not shown) for emitting the air-gas mixture and feeding the flame. Burner 3 is housed inside exchanger 4 which, in fact, also acts as a combustion chamber. Heat exchanger 4 is substantially cylindrical in shape, extends along a substantially horizontal axis A1, and comprises a casing 10, through which the combustion products flow; a tube 11, along which water flows; and a disk 12 for directing the fumes along a given path inside exchanger 4. Casing 10 comprises a cylindrical lateral wall 13 about axis A1; an annular wall 14 connected to lateral wall 13, to supply pipe 6, and to burner 3; and an annular wall 15 connected to lateral wall 13 and to exhaust pipe 7. Burner 3 extends, coaxially with exchanger 4, inside of exchanger 4 for a given length. Tube 11 coils about axis A1 to form a helix 16 comprising a succession of adjacent turns 17, each located close to lateral wall 13, and has two opposite ends with known fittings (not shown) for connecting tube 11 to water circuit 9 outside exchanger 4. Disk 12 is shaped so as to fit with the shape of the coiled tube 11.

Exchanger 4 comprises three spacers 18 for keeping turns 17 a given distance from lateral wall 13. Each spacer 18 comprises a straight portion 19 parallel to axis A1, and from which project fingers 20 for clamping the helix 16.

Figure 2:
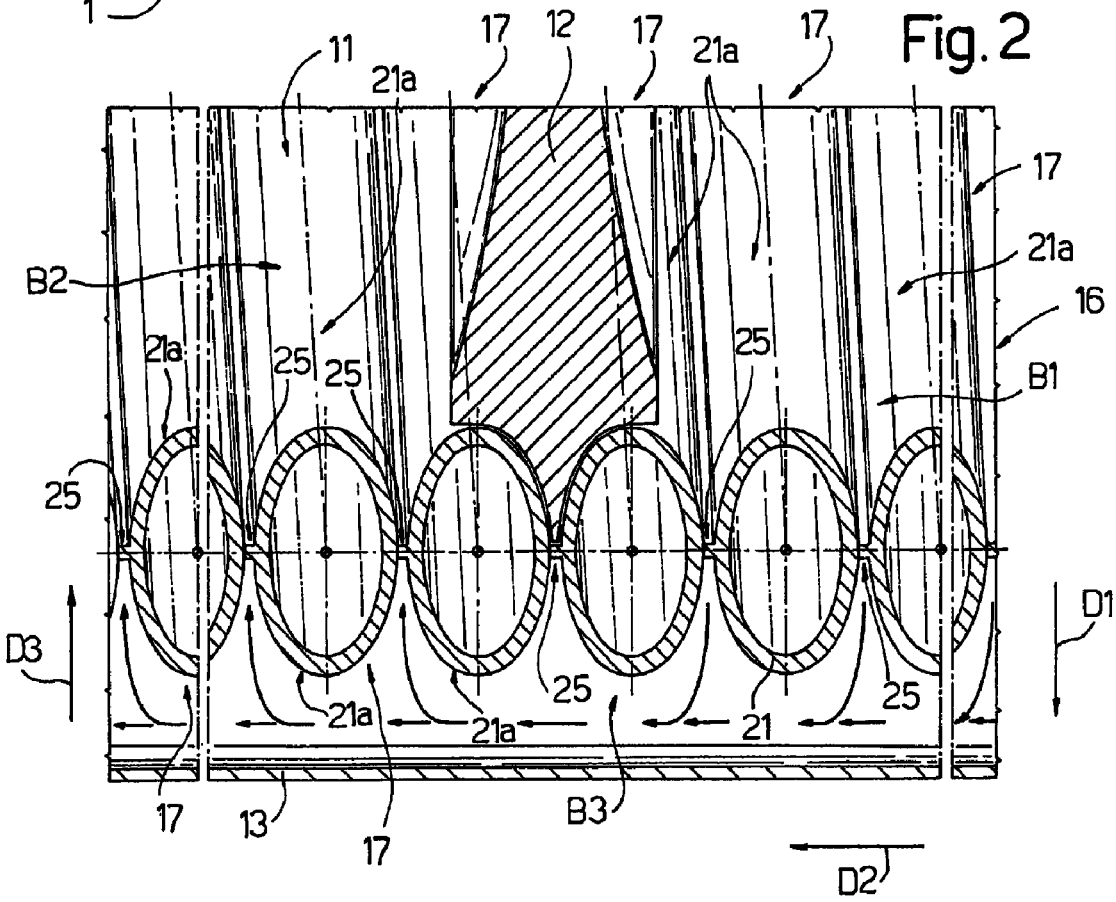
FIG. 2 shows a larger-scale section of a detail of the FIG. 1 heat exchanger.

With reference to FIG. 2, tube 11, disk 12, and spacers 18 define, inside casing 11, a region B1 housing burner 3; a region B2 communicating directly with exhaust pipe 7; and three regions B3, each extending between two spacers 18, turns 17, and lateral wall 13. Combustion of the air-gas mixture takes place in region B1; and the resulting fumes, being prevented by disk 12 from flowing directly to region B2, flow between turns 17, in a direction D1 substantially perpendicular to axis A1, to regions B3, along which they flow in a direction D2 substantially parallel to axis A1. On reaching regions B3, the fumes flow between turns 17 in direction D3 opposite to D1 to region B2 and then along exhaust pipe 7.

Figure 3:
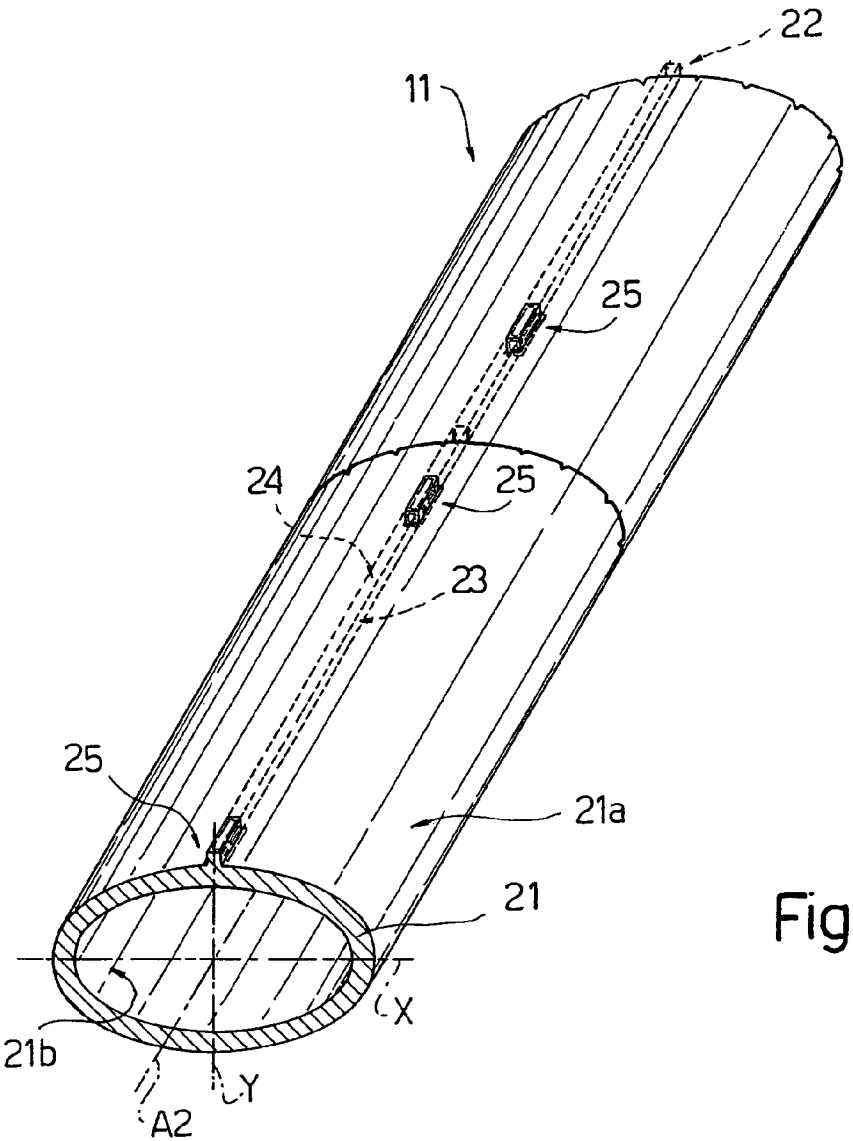
FIG. 3 shows a view in perspective of a tube used to produce the FIG. 1 exchanger.

Tube 11 is preferably made of aluminium or aluminium-based alloy. With reference to FIG. 3, tube 11 is an extruded tube, which extends along an axis A2, and comprises a wall 21 with an oval cross-section (major axis X and a minor axis Y) and a longitudinal rib 22 shown partially in dotted lines in FIG. 3. Wall 21 has an outer surface 21*a* and an inner surface 21*b* and a constant thickness. Rib 22 protrudes from the outer surface 21*a* at the intersection of outer surface 21*a* and minor axis Y and has two lateral faces 23 substantially parallel to minor axis Y and a distal face 24 substantially parallel to major axis X. In other words, rib 22 protrudes from the area of the cross section having the largest radius.

After extrusion, rib 22 is partially machined in order to separate teeth 25, which, in the best embodiment, are equally distributed along the length of the tube 11. Each tooth 25 has a cross-section corresponding to the cross-section of rib 22.

In an alternative embodiment, not shown, the cross-section of teeth 25 is modified by reducing the height of the teeth 25 by machining.

As an example of the sizes of the teeth 25 and of the tube 11, tube 11 may have an axis Y 20 mm high and teeth 0.8 mm high per 1.1 mm wide. The ratio between the height of the tube 11 and the eight of the teeth 25 is roughly about 23.

Once the rib 22 is machined, tube 11 is coiled about axis A1, so that axis A2 of tube 14 also assumes a helical shape. Tube 11 is coiled with a constant pitch and radius, so that each turn 17 faces an adjacent turn 17. This operation actually comprises calendering tube 11, with the minor axis Y of the section of tube 11 maintained substantially parallel to axis A1. The three spacers 18 are then fitted to helix 16, and arranged 120 degrees apart, so as to compress turns 17 along axis 1.

Then, teeth 25 of a given turn 17 comes into contact with the outer surface 21*a* of the adjacent turn 17 so as to form a gap between the two adjacent turns 17.

With reference, to FIG. 2, the fumes flow from region B1 to regions B3 in direction D1 towards wall 13, then flow in direction D2 between turns 17 and wall 13, flow between turns 17 in direction D3 from regions B3 to region B2, and are finally expelled by exhaust pipe 7. The successive gaps therefore define compulsory fume paths.

Figures 4, 5:
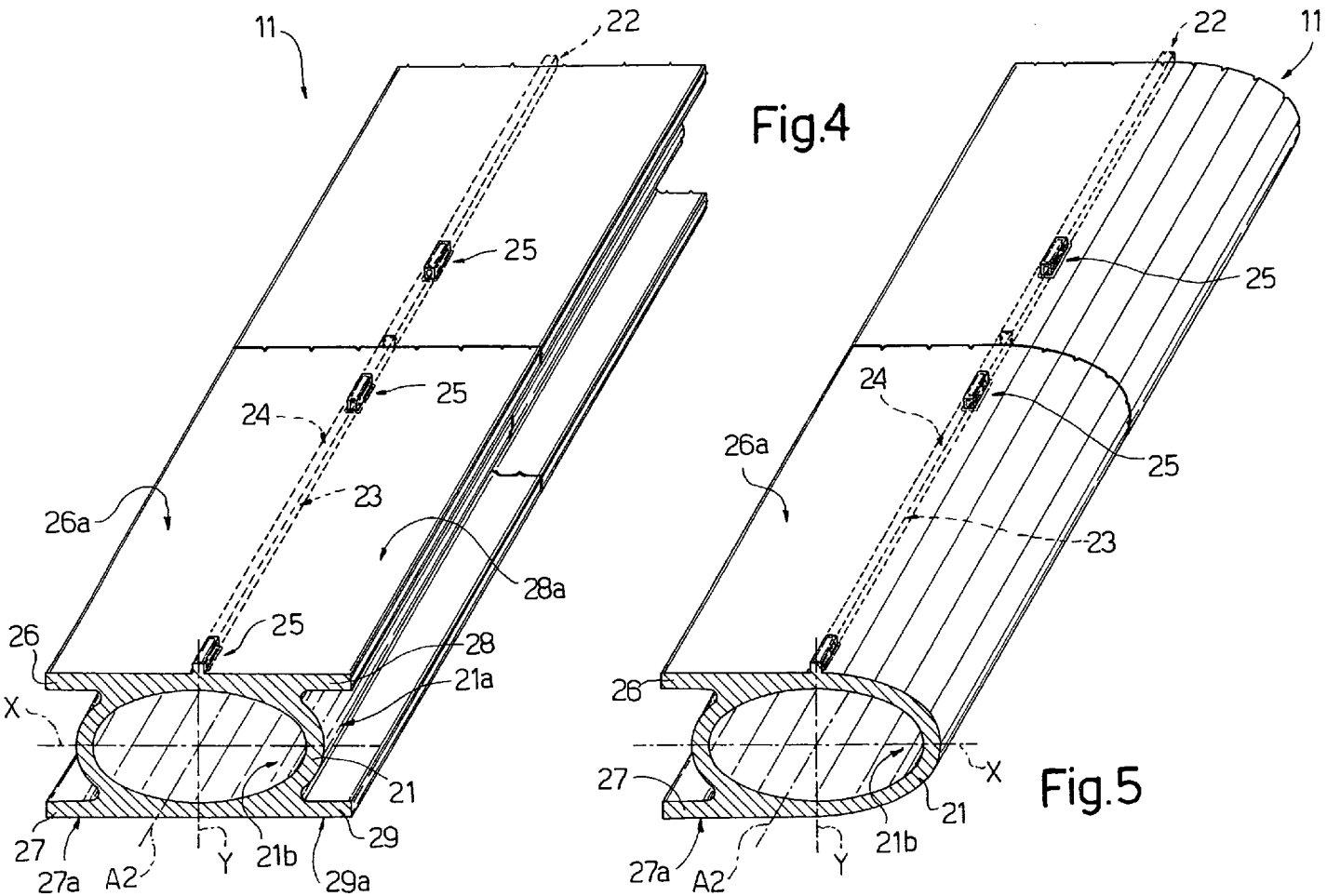
FIGS. 4 and 5 shows variations of the FIG. 3 tube.

With reference to the FIG. 4 variation, tube 11 is provided with four fins 26, 27, 28, and 29 tangent to wall 21 and parallel to each other and to major axis X. Fins 26 and 27 are located on the same side of tube 11, whereas fins 28 and 29 are located on the opposite side. Then, fin 26 is coplanar to fin 28 and fin 27 is coplanar to fin 29. Fins 26, 27, 28 and 29 have a surface 26*a*, 27*a*, 28*a*, and 29*a*, which is tangent to outer surface 21*a* of wall 21 so that surfaces 26*a* and 28*a* form a single surface from which teeth 25 protrude. Surfaces 27*a* and 29*a* form a single surface without any protruding teeth 25. Once tube 11 is coiled in a helix 16 and clamped by spacers 18, teeth abut against the single surface formed by surfaces 27*a* and 29*a*.

With reference to the FIG. 5 variation, tube 11 is provided with fins 26 and 27, fins 28 and 29 being omitted.

Many other variations in shape of tube 11 cross-section and arrangement of the fins are possible without departing from the essence of the present invention.

Exchanger 4 as described above may also be used in condensation boilers comprising a main exchanger, and in which exchanger 4 provides solely for condensing the fumes, as opposed to acting as a combustion chamber as in the example described.

Exchanger 4 as described above has numerous advantages, by combining straightforward construction as a result of teeth 25 formed directly by the tube 11 extrusion process and extremely flexible machining operation.

Even though the embodiment disclosed in the detailed description refers to a tube 11 coiled in a helix 16 to form a plurality of turns, the invention is not limited to this embodiment and turns 17 should be intended more generally as adjacent tube sections.

The invention claimed is:

1. A heat exchanger for a gas boiler for producing hot water; the heat exchanger comprising a casing extending along a first axis (A1) and through which combustion fumes flow; an extruded tube with an oval cross-section having a major axis and a minor axis, the tube having integrally formed longitudinal continuous fins extruded thereon; the tube having only a single integrally formed longitudinal rib extruded thereon on one side and positioned at the intersection of an outer surface thereof aid the minor axis and substantially perpendicular to fins; the single integral rib being partially machined to form a plurality of gap forming teeth there from; the tube being coiled about axis A1 at a constant pitch so that each resulting turn faces and lies in contact with an adjacent turn with the minor axis being maintained substantially parallel to axis A1 thereby forming a plurality of turns along which water flows; said turns being arranged inside said casing so that the plurality of teeth contact adjacent turns along the length of the tube so as to form gaps between adjacent turns; a deflector mounted within the turns; and the plurality of spaced apart machined teeth form gaps at an area of the extruded tube cross section having the largest radius.

2. The heat exchanger as claimed in claim 1, wherein the plurality of teeth are oriented to be substantially radial with respect to said tube.

3. The heat exchanger as claimed in claim 1, wherein the plurality of teeth are evenly distributed along the length of each tube.

4. The heat exchanger as claimed in claim 1, wherein the tube is formed.

5. The heat exchanger as claimed in claim 1, wherein the tube is coiled in a helix comprising a plurality of turns.

6. The heat exchanger as claimed in claim 1 wherein the tube has an oval shaped cross section and each tooth protrudes from one side of the tube.

7. A method of forming a heat exchanger tube comprising the steps of:

extruding an endless tubular structure having a predetermined cross sectional shape;

simultaneously forming only a single endless rib along one side of an outside surface of a defined portion of a side wall of the tubular structure that will, when formed into a wound coiled structure, be positioned adjacent a side wall portion that is free of any other formed structure and will be located directly opposite the defined portion;

removing selected portions of the single endless rib to form a plurality of spaced apart teeth; and coiling the extruded tube into a helical shape while coiling at a constant pitch and radius so that each successive turn faces and touches an adjacent turn thereby placing each of the plurality of spaced apart teeth formed from the single endless rib along the coiled extruded tube at particular locations in contact with an outer wall portion of such adjacent turns opposite the defined portion of such adjacent turns bearing the plurality of teeth.

8. The method as in claim 7 including the further step of extruding at least one endless fin structure along with the tube with the at least one fin being located at a position normal to the rib.

9. The method as in claim 7 wherein the tubular structure has an oval cross sectional shape with a major and a minor axis.

10. The method as in claim 9 wherein the step of coiling positions the plurality of teeth at the point of the minor axis of the adjacent turns.

11. The method as in claim 9 wherein the step of coiling positions the plurality of teeth at the point of the greatest radius of the adjacent turns.

12. The heat exchanger as in claim 1 wherein the tubing has an oval cross sectional shape with a major and minor axis, the plurality of teeth being formed on only one exterior side of the extruded tube and positioned at the point of the minor axis.

13. A heat exchanger for a gas boiler for producing hot water; the heat exchanger comprising a casing extending along a first axis (A1) and through which combustion fumes flow; an extruded tube with an oval cross-section having a major axis and a minor axis, the tube having integrally formed longitudinal continuous fins extruded thereon; the extruded tube having only a single integrally formed longitudinal rib extruded thereon on one side and positioned so as to be substantially perpendicular to the fins; the integral rib being partially machined to form a plurality of spaced apart teeth there from; the extruded tube being coiled about axis A1 at a constant pitch so that each resulting successive turn faces and contacts an adjacent turn with the minor axis being maintained substantially parallel to axis A1 thereby forming a plurality of turns along which water flows; said plurality of turns being arranged inside said casing so that the plurality of spaced apart teeth formed from the machined single integrally formed longitudinal rib lie in contact with adjacent turns so as to position the coiled tube and form gaps between adjacent turns at an area of the extruded tube cross section having the largest radius; and a deflector mounted within the turns.

* * * * *